United States Patent [19]

Avitan

[11] Patent Number: 5,069,632

[45] Date of Patent: Dec. 3, 1991

[54] ELECTRICAL SUPPLY SAFETY SOCKET

[75] Inventor: Shimon Avitan, Holon, Israel

[73] Assignee: Magen Oshrat Ltd., Holon, Israel

[21] Appl. No.: 442,976

[22] Filed: Nov. 29, 1989

[51] Int. Cl.[5] ..... H01R 13/703

[52] U.S. Cl. ..... 439/188; 200/51.09; 439/593

[58] Field of Search ..... 439/188, 181, 182, 592, 439/593; 200/51.09, 51.1

[56] References Cited

U.S. PATENT DOCUMENTS

| | | | |
|---|---|---|---|
| 2,184,359 | 12/1939 | Mueller | 200/51.09 |
| 2,735,906 | 2/1956 | Avrunin | 200/51.09 |
| 3,895,195 | 7/1975 | Morrison et al. | 200/51.09 |
| 4,008,403 | 2/1977 | Rose | 200/51.09 |
| 4,456,322 | 6/1984 | Ferroni | 200/51.09 |
| 4,623,209 | 11/1986 | Mangone | 439/181 |

FOREIGN PATENT DOCUMENTS

WO81/01082 4/1981 PCT Int'l Appl. .

*Primary Examiner*—Neil Abrams

*Attorney, Agent, or Firm*—Browdy and Neimark

[57] ABSTRACT

An electrical safety socket in which the neutral and live socket outlets are electrically isolated until substantially parallel pins of a two- or three-in plug are inserted therein. The neutral and live socket outlets are resiliently biased into a non-parallel disposition such that insertion of a plug into the socket rotates them into a mutually parallel orientation, at the same time causing laterally disposed abutting means to impinge on a switch assembly, thereby closing neutral and live switches connected between the live and neutral feeders and the respective socket outlets. Also disclosed is a safety lamp socket having a split collar which is splayed apart upon insertion of a lamp. Armatures attached to respective collar components are thereby pivotally displaced about pivots fixed to the socket housing, opposite ends of the armatures impinging on neutral and live switch contacts so as to close the corresponding switches and connect the neutral and live feeders to the respective socket outlets.

10 Claims, 9 Drawing Sheets

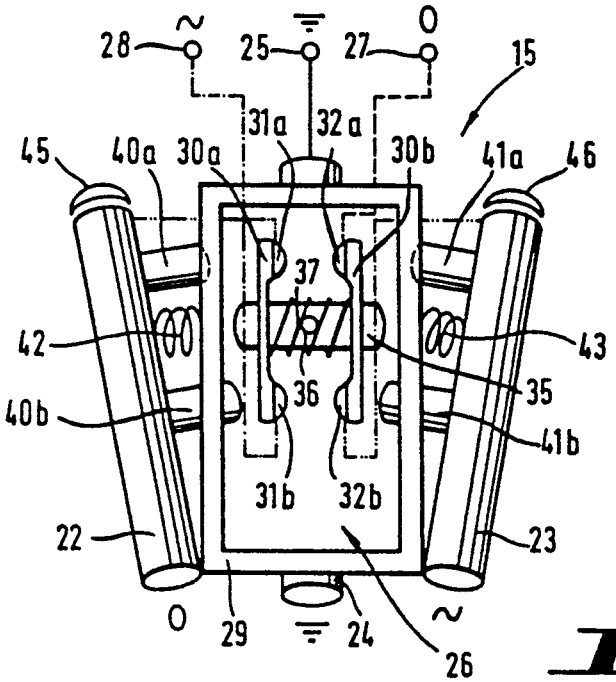
Fig. 1a
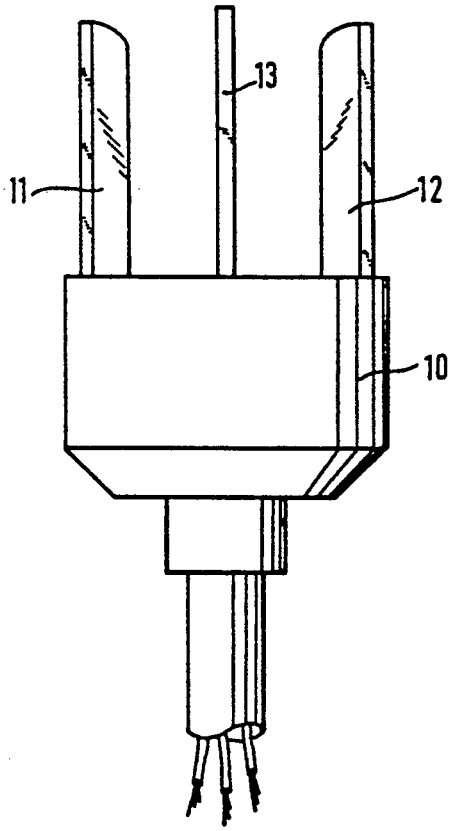

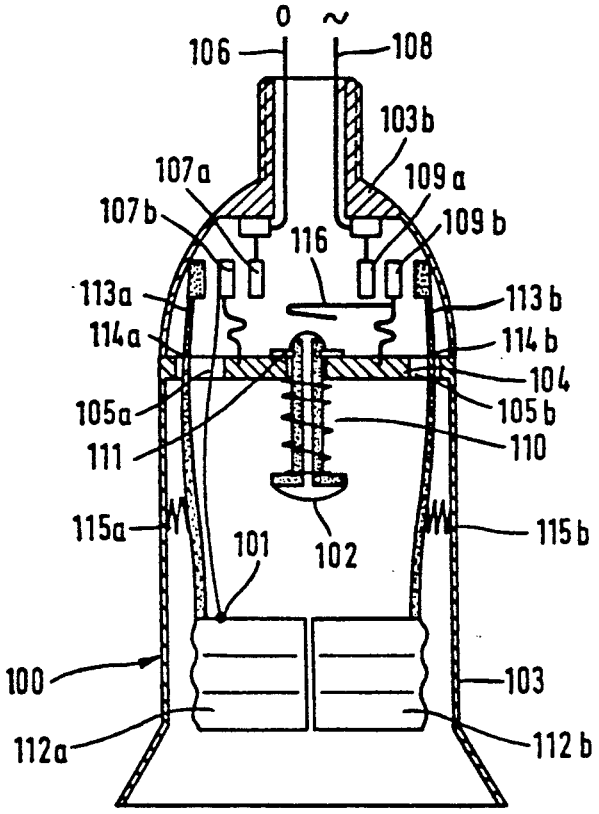
Fig. 7a
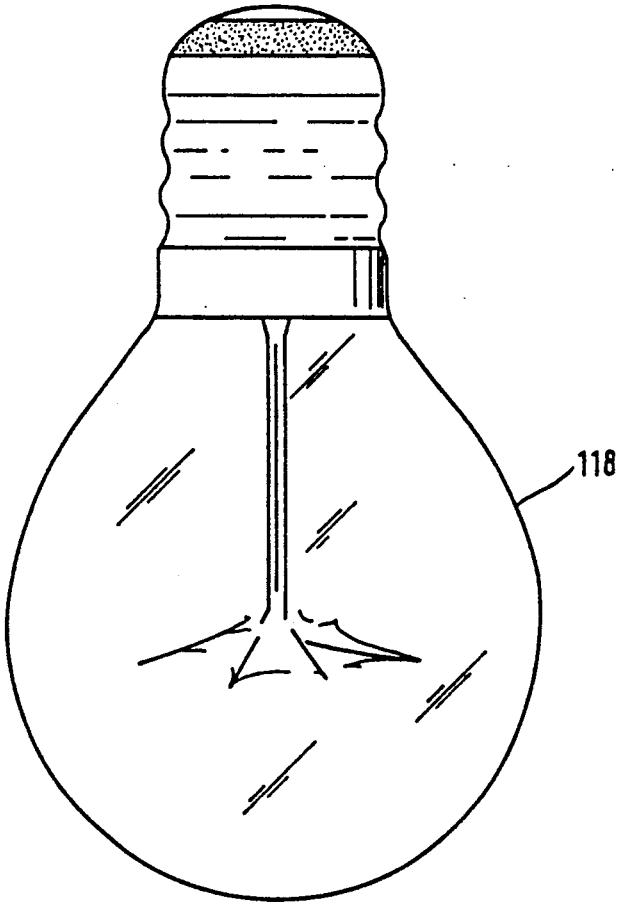

0
~
106
108
103b
116
113a
113b
114a
114b
105a
105b
111
110
104
102
115a
115b
101
100
103
112a
112b
118

ELECTRICAL SUPPLY SAFETY SOCKET

FIELD OF THE INVENTION

This invention relates generally to an electrical supply safety socket and, in particular, to such a socket which is childproof. The general features of the invention are applicable to all mains supply sockets whether or not they are provided with a ground outlet, and there are additional features which may be provided specifically with a socket having a ground outlet. The term "socket" is taken to refer to any type of female connector for connecting a source of electric power to an appliance including, for example, wall and extension electricity supply sockets as well as electric light sockets.

BACKGROUND OF THE INVENTION

It is known to provide mains supply safety sockets wherein the live and neutral outlets are covered with an insulating plate which is adapted to retract when the ground pin of a three pin plug is inserted into the ground outlet of the socket. It is generally arranged in such systems for the ground pin to be slightly longer than both the neutral and live pins in order to facilitate the operation of the safety mechanism.

The major drawback with such a system is that the insulating plate is liable to jam. If it jams in the closed position the socket is unusable, and if it jams in the open position the socket is usable but the safety device is inoperative. Furthermore, such a system is not childproof in that it is readily appreciated that insertion of a ground pin, or any substitute therefor, will on its own retract the insulating plate, thereby overriding the safety mechanism. Indeed, this approach is sometimes adopted in order to connect the supply leads from an electrical appliance directly to the mains without first attaching a plug to the appliance, and is obviously highly unsatisfactory from a safety point of view.

U.S. Pat. No. 4,623,209 (Mangone) describes an electrical safety socket including normally open switches for connecting the live and neutral feeders to their respective socket outlets. The switches close when substantially parallel live and neutral pins of an electric plug are inserted into their corresponding socket outlets simultaneously. In such an arrangement, the insertion of each plug pin is adapted to pull a respective lever located external to the plug housing and articulated to a corresponding one of the switches. Such an arrangement allows independent operation of the switches and, since the levers are accessible from outside the plug housing, they may easily be operated independently of a plug being inserted into the socket. Consequently, foreign objects may be introduced into either socket outlet and the appropriate switch closed manually in order to complete the connection.

U.S. Pat. No. 4,008,403 (Rose) describes a safety socket for an electrical lamp, the shell and tip contacts of which are connected to respective supply feeders via normally open switches. The switches are operated by an electromagnetic relay which receives power via the shell contact when an external momentary make switch is closed. Additional safety is provided by splitting the shell contact into two halves such that electrical contact between them is effected only when a lamp is inserted into the socket. Thus, the split shell contact acts as switch for operating the electromagnetic relay.

SUMMARY OF THE INVENTION

It is an object of the invention to provide a electrical supply safety socket which overcomes the disadvantages of hitherto proposed systems.

According to one aspect of the invention there is provided an electrical safety supply socket comprising:

a socket housing, first and second socket outlets articulatedly mounted with respect to the housing so as to be capable of pivotal displacement with respect to each other, a first switch having a pair of contacts connected respectively to a first feeder and the first socket outlet, a second switch having a pair of contacts connected respectively to a second feeder and the second socket outlet, first spring biasing means for biasing the outlets into a non-parallel disposition, an armature support pivotally mounted on the housing, a pair of insulating armatures articulated to the support so as to be pivotally displaceable therewith and so as to be displaceable towards and away from each other, thereby bringing respective first and second switch contacts towards and away from each other, second spring biasing means for biasing the armatures away from each other, and abutting means extending laterally from the outlets to the armatures;

whereby simultaneous displacement of the outlets into a substantially parallel disposition results in the displacement of the armatures towards one another and the contacting of the switch contacts.

The first and second switches are thus adapted to switch the live and neutral feeders to their respective outlets only when the plug connected to an electrical appliance is inserted into a socket. Consequently, with no plug inserted into the socket, the live and neutral feeders are disconnected from their respective outlets, thereby eliminating the risk of electric shock to a person making contact with the live outlet.

In a first embodiment according to the invention, an armature support is pivotally mounted on the socket housing, substantially centrally between the live and neutral outlets, about which support pivots a switch assembly comprising the two armatures, to each end of which are attached the first and second contacts, respectively, of each pair. A spring included in the switch assembly biases the two armatures apart and, therefore, the live and neutral switches into an open position. The armatures are articulated to the support so as to be pivotally displaceable therewith and so as to be displaceable towards and away from each other so as to bring the first and second pairs of contacts into and out of contact with each other. Second spring means associated with each outlet are adapted to bias the live and neutral outlets into a mutually non-parallel disposition, and each outlet is coupled to one of the armatures in the switch assembly by transversely directed abutting means.

When a single object (e.g. a nail) is inserted into only one of either the live or neutral outlets, even complete insertion will have no effect on the switching mechanism and, consequently, neither of the feeders will be connected to their respective outlets. If, however, a nail is inserted into only one of the socket outlets and then rotated against the armature armatures, the transversely directed abutting means associated with that outlet will impinge against the corresponding armature in the switch assembly and will cause the complete switch assembly to rotate about the pivotal support, the live and neutral switches still being maintained in an open position by their corresponding armatures.

Only when two objects are inserted, one into each socket outlet, and then rotated against both of the corresponding armature armatures, will the armatures be able to overcome both the armature armatures and the contact armatures, thereby closing both the live and neutral switches.

It may be assumed that children, in particular, who insert nails into electrical sockets, will insert them as far as they will go. Therefore, arresting means associated with each of the live and neutral socket outlets are preferably formed in the socket housing whereby a nail inserted completely into either of said outlets will engage the corresponding arresting means thereby preventing rotation of the socket outlet.

In a second embodiment according to the invention, there are additionally provided third and fourth switches connected in series with the first and second switches, whereby partial insertion of the parallel pins of a plug connected to an electrical appliance will overcome the armatures associated with each of the live and neutral outlets, thereby closing the corresponding first and second switches. When the plug pins are completely inserted into the socket outlets, thereby impinging on second armatures located inside the outlets, the third and fourth switches close, thus completing the circuits to the corresponding live and neutral feeders.

In an improved arrangement according to the second embodiment of the invention, a second normally open live switch is provided which is closed when the ground pin of a three-pin electrical plug is inserted into a corresponding ground socket outlet. A fuse mounted within the socket housing, and preferably replaceable without dismantling said housing, is connected in series with the first live switch. When an appliance connected to a two-pin plug is inserted into the socket, electrical power is supplied to the appliance through the fuse. In the event of a fault occurring in the appliance, the fuse will blow, thereby interrupting power flow to the appliance. However, power will still be available via the second live switch to an appliance which is connected to the socket via a three-pin plug.

According to a second aspect of the invention, the principles of the invention are employed within an electrical mains supply safety lamp socket. In the Edison-type screw lamp, for example, contacts are provided in the screw cap of the lamp, a ring contact being connected to the threaded portion of the screw cap and a tip contact being connected to the end of the screw cap. In the safety lamp socket according to the invention, the screw collar provided within the conventional socket shell is formed of two component portions respectively connected to insulating armatures and spring biased towards each other. When a lamp is screwed into the housing, the armatures are displaced, thereby closing normally open neutral and live switches as in the first embodiment. Only then are the neutral and live feeders connected to their respective outlets within the socket housing, so that the socket is electrically isolated before a lamp is inserted.

BRIEF DESCRIPTION OF THE DRAWINGS

Various embodiments of the invention will now be described with reference to the accompanying drawings, in which:

FIGS. 1*a* and 1*b* are schematic representations of a socket in accordance with a first embodiment of the invention together with a plug;

FIGS. 7*a* and 7*b* are pictorial representations of a lamp socket according to a third embodiment of the invention.

DETAILED DESCRIPTION OF PREFERRED EMBODIMENTS

Figure 1B:
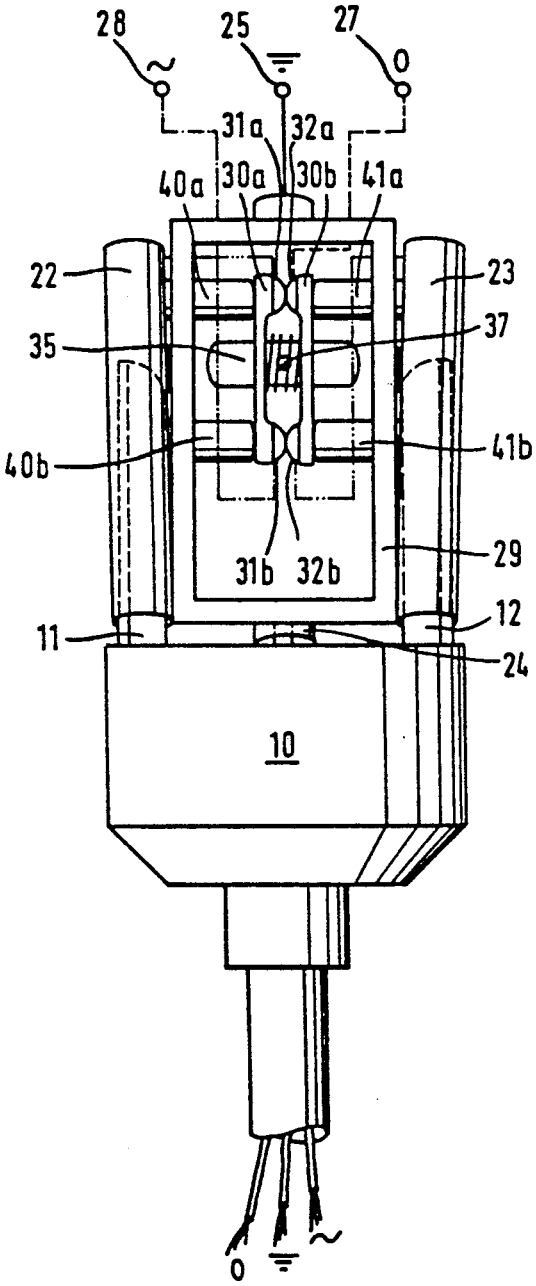
Figure 2:
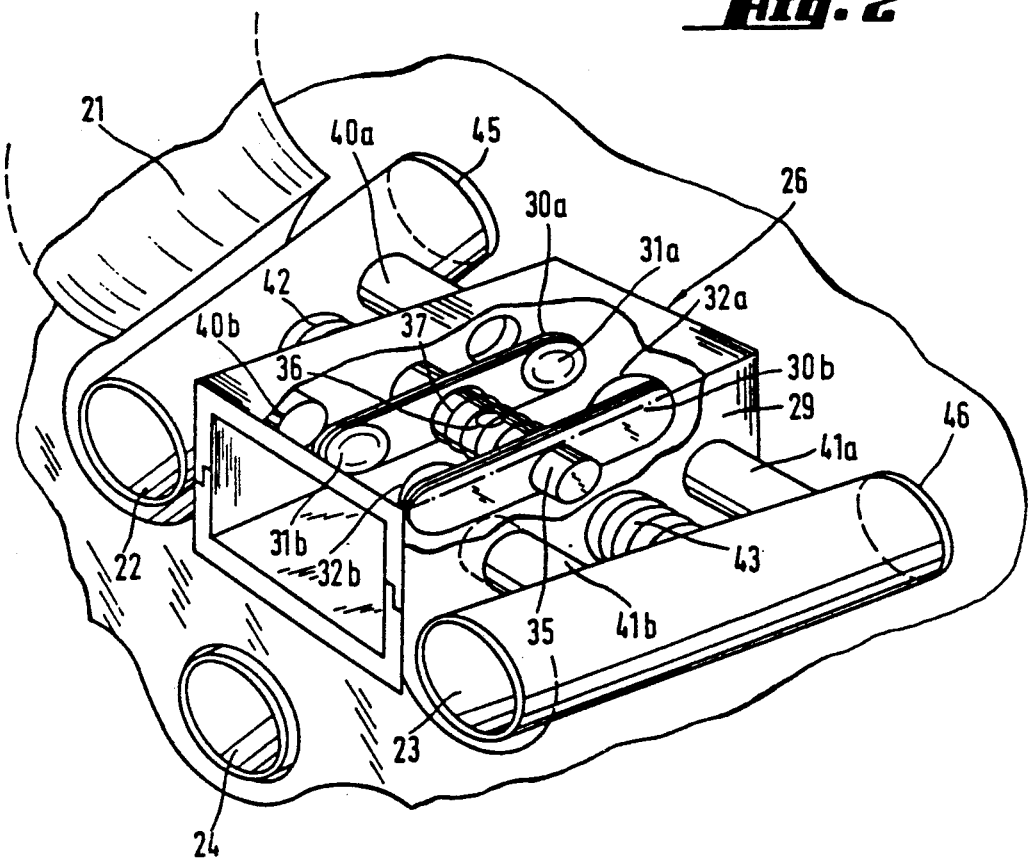
FIG. 2 is a perspective view of a section of the socket shown in FIG. 1 showing in greater detail the arrangement of the socket outlet and the switch assembly.

Referring to FIGS. 1*a*, 1*b*, 2 and 3 there is illustrated a first embodiment according to the invention. Unless otherwise indicated, reference will be made to FIG. 1. There is here shown a plug 10 having neutral, live and ground pins 11, 12 and 13 respectively and a socket designated generally as 15. The socket 15 comprises a front plate 20 (FIG. 3) behind which is mounted a socket housing 21 (FIG. 2) within which are mounted tubular neutral, live and ground outlets 22, 23 and 24. A ground feeder 25 is connected directly to the ground outlet 24. The electrically conducting neutral and live outlets 22 and 23 are seated within the housing 21 in a non-parallel disposition such that their front ends, substantially abutting the front plate 20 (FIG. 3), are closer together than their rear ends. Between the neutral outlet 22 and the live outlet 23 is a switch assembly 26 which is arranged to connect a neutral feeder 27 to the neutral outlet 22 and a live feeder 28 to the live outlet 23 when substantially parallel pins, inserted into both the neutral outlet 22 and the live outlet 23, move these outlets into a substantially parallel disposition.

Figure 3:
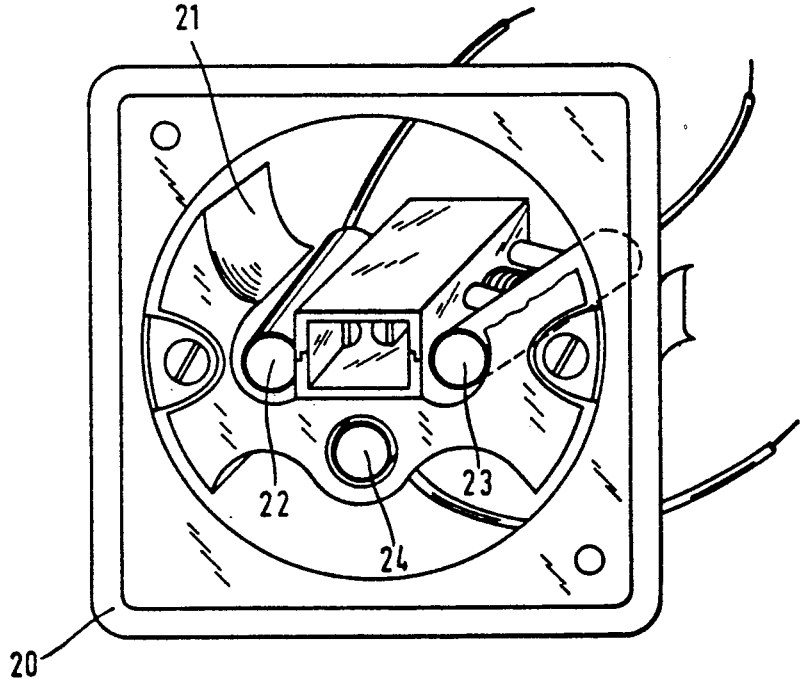
FIG. 3 is a pictorial representation of the socket shown in FIGS. 1 and 2.

By way of schematic representation, the switch assembly 26 is shown surrounded by a rectangular framework 29. In a practical embodiment, the two side faces of the rectangular framework 29 adjacent the neutral outlet 22 and the live outlet 23, as well as one of the connecting faces, will be formed integrally with the socket housing 21 as shown in FIG. 3.

The switch assembly 26 comprises first and second armatures 30*a* and 30*b*, preferably made of insulating bars, to which are connected first and second switches comprising contacts 31*a*, 32*a* and 31*b*, 32*b* respectively. The first switch contacts 31*a* and 32*a* are fixed to a first end of each armature and the second switch contacts 31*b* and 32*b* are fixed to the opposite end of each armature. The first switch contacts 31*a* and 32*a* constitute a neutral switch and the second switch contacts 31*b* and 32*b* constitute a live switch.

Apertures (not shown) are formed at the centre of the armatures 30*a* and 30*b* through which passes slidably a rod 35 constituting an armature support. The rod 35 is itself pivotally coupled to the socket housing 21 by means of a pin 36 positoned at the longitudinal centre of the rod 35, thereby permitting the complete switch assembly 26 comprising the armatures 30*a* and 30*b* together with the rod 35 to pivot about the pin 36. Located on the rod 35 between the armatures 30*a* and 30*b* is a spring 37 which biases the armatures 30*a* and 30*b* apart, thereby maintaining the neutral switch 31*a*, 32*a* and the live switch 31*b*, 32*b* in a normally open position.

Abutting means 40*a* and 40*b* are transversely mounted through the side of the switch assembly housing 29 adjacent to the neutral outlet 22, thereby transmitting displacement of the neutral outlet 22 to the armature 30*a*. Similarly, abutting means 41*a* and 41*b* are transversely mounted to the side of the switch assembly housing 29 adjacent to the live outlet 23, thereby transmitting displacement of the live outlet 23 to the armature 30*b*. A spring 42 fixed to the side of the switch assembly housing 29 adjacent to the neutral outlet 22 between the abutting means 40*a* and 40*b*, and a corresponding spring 43 fixed to the other side of the switch assembly housing 29 between the abutting means 41*a* and 41*b*, bias the neutral outlet 22 and the live outlet 23 into a non-parallel disposition wherein their front ends are closer to each other than are their rear ends.

Formed within the socket housing 21 and behind the rear ends of the neutral outlet 22 and the live outlet 23, respectively, are bores 45 and 46 drilled flush with the rear ends of the respective socket outlets. The bores 45 and 46 constitute arresting means and serve to prevent pivotal motion of the neutral outlet 22 or of the live outlet 23 when a single pin is fully inserted into either of these outlets so as to engage the corresponding bores 45 and 46.

The operation of the socket is as follows. Insertion of a pin into either the neutral outlet 22 or the live outlet 23 will have no effect until the pin is pivotally rotated so as to bring the corresponding outlet into an orientation substantially parallel to the ground outlet 24. When, for example, a pin is inserted into the neutral outlet 22 only and rotated in the prescribed manner, the outlet 22 will also rotate against the force of the spring 42 and the abutting means 40*a*, 40*b* will be displaced towards the corresponding ends of the armature 30*a*. The contacting of the armature 30*a* by one or other of the abutting means 40*a*, 40*b* imparts an uncompensated turning moment to the armatures 30*a* and 30*b* and the rod 35 and as a result the switch assembly 26 will start to rotate about pin 36. As a consequence, the insertion of an object into the neutral outlet 22 and subsequent maximum rotation of the neutral outlet 22 will not result in the closing of either the neutral switch 31*a*, 32*a* or the live switch 31*b*, 32*b*.

In an identical manner, it may be arranged that insertion of a pin into the live outlet 23 and subsequent maximum rotation of the live outlet 23 is insufficient to close the first and second switches.

However, when the two substantially parallel neutral and live pins 11, 12 of a two-or three-pin plug 10 are inserted into the neutral and live sockets 22 and 23 together, as shown schematically in FIG. 1*b*, the abutting means 40*a* and 40*b* impinge on the armature 30*a* and the abutting means 41*a* and 41*b* impinge against the armature 30*b*. This combined force on each armature overcomes the spring force 37 and prevents the armature assembly from swivelling about the pin 36. Thus, when the neutral outlet 22 and the live outlet 23 are brought into a mutually parallel position in the manner just described, the armatures 30*a* and 30*b* will be pushed together, thereby closing the neutral switch 31*a*, 32*a* and the live switch 31*b*, 32*b*.

This embodiment therefore provides for an improved electrical mains supply safety socket wherein the neutral and live feeders are connected to their respective non-parallel socket outlets only when the outlets are moved into a substantially parallel disposition. Furthermore, it is a feature of this embodiment that a faulty appliance plug having loose pins will be unable to move the socket outlets as required when inserted into such a socket, thereby preventing the flow of electric power to the appliance connected to the plug.

Figure 4A:
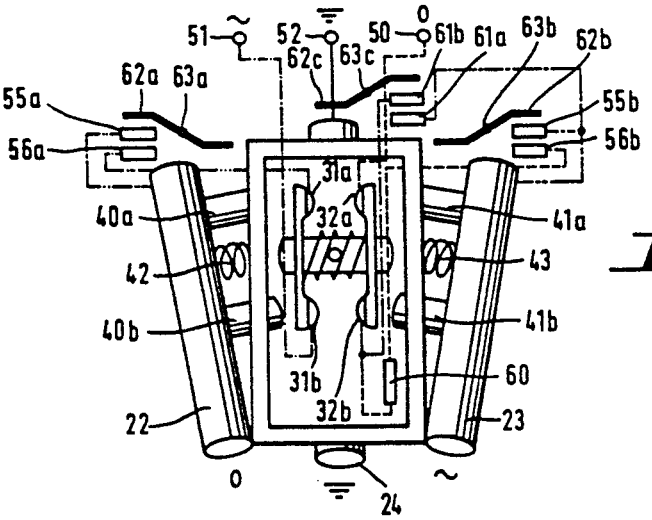
FIGS. 4*a*, 4*b* and 4*c* are schematic representations of a socket according to a second embodiment of the invention.
Figure 4B:
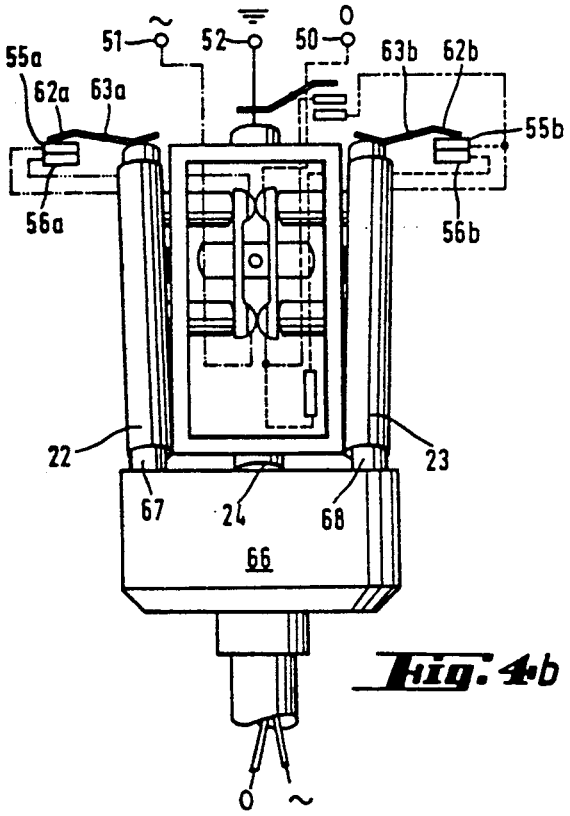
Figure 4C:
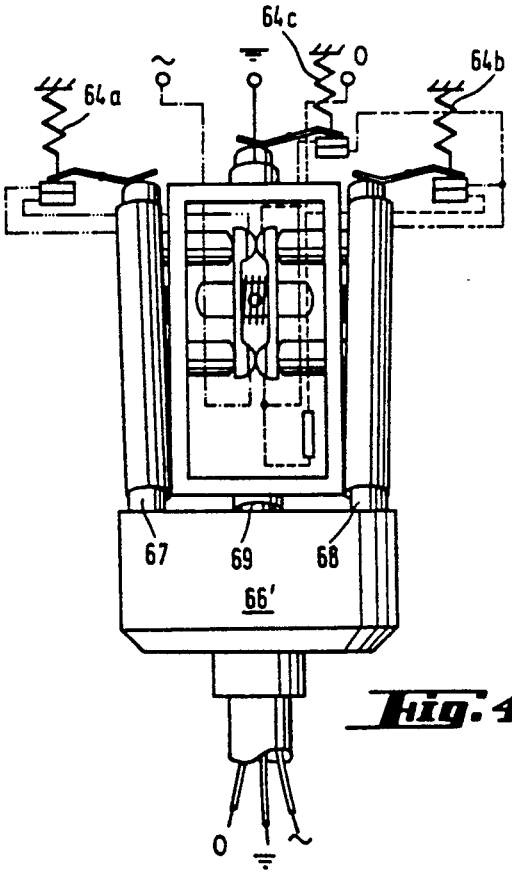

Referring to FIGS. 4*a*, 4*b* and 4*c*, there is illustrated a second embodiment employing the principles of the first embodiment. Additionally, there is included an optional feature whereby a circuit protection device provided within the socket housing allows interruption of the electricity supply to the live outlet in the event of a fault in an electrical appliance fitted with a two-pin plug but, nevertheless, will still permit an electrical appliance fitted with a three-pin plug (i.e., also including a ground pin) to continue functioning.

FIG. 4*a* shows an arrangement whereby a three-pin socket in accordance with the first embodiment comprising neutral, live and ground outlets 22, 23 and 24 are connected to neutral, live and ground feeders 50, 51 and 52, respectively. The ground feeder 52 is connected directly to the ground outlet 24. The neutral outlet 22 is connected to a first contact 55*a* of a third switch whose second contact 56*a* is connected directly to contact 31*a* described with reference to FIGS. 1*a* and 1*b*. Contact 32*a* is connected directly to the neutral feeder 50. The live outlet 23 is connected to a first contact 55*b* of a fourth switch whose second contact 56*b* is connected via a fuse 60 to the armature contact 32*b*. The matching armature contact 31*b* is connected directly to the live feeder 51. Additionally, the live outlet 23 is connected to a first contact 61*a* of a fifth switch whose second contact 61*b* is connected directly to contact 32*b*.

Thus, the first and third switches constitute first and second neutral switches whilst the second, fourth and fifth switches constitute first, second and third live switches. The second neutral and the second and third live switches are normally open and are closed when acted upon by insulating armatures 62*a*, 62*b* and 62*c*, respectively. The armatures 62*a*, 62*b* and 62*c* are pivotally supported by means of pins 63*a*, 63*b* and 63*c*, respectively, fixed to the socket housing (not shown) and engageable with the first contacts 55*a*, 55*b* and 61*b* of the corresponding switches. Compression springs 64*c*, 64*b* and 64*c* (FIG. 4*c*) fixed to the socket housing impinge against one end of each armature 62*a*, 62*b* and 62*c*, respectively, thereby preventing the armatures from touching the first contacts 55*a*, 55*b* and 61*b*. In this condition, the second neutral and the second and third live switches are open circuit.

FIG. 4*b* shows the operation of the socket when a two-pin plug 66 is inserted into the neutral outlet 22 and the live outlet 23. The second neutral switch 55*a*, 56*a* is activated by means of armature 62*a* when a neutral pin 67 is fully inserted into the neutral socket. The armature 62*a* pivots about pin 63*a*, thereby closing contacts 55*a* and 56*a*, and connecting the neutral feeder to the neutral socket outlet. Similarly, a live pin 68 of the two-pin plug 66 fully inserted into the live outlet 23 will close the second live switch 55*b*, 56*b*. The live feeder 51 will now be connected to the live outlet 23 via both the first and second live switches in series with the fuse 60. A fault in the appliance to which the two-pin plug 66 is connected will cause fuse 60 to blow thereby deenergizing the live feeder 51 from the live outlet 23.

FIG. 4c shows the operation of the socket when a three-pin plug 66 is inserted into the neutral outlet 22, the live outlet 23 as well as the ground outlet 24. The method of connection of the neutral feeder 50 to the neutral outlet 22 is exactly as described above with reference to FIG. 4b. However, complete insertion of a ground pin 69 into the ground outlet 24 will cause armature 62c to close the third live switch 61a, 61b which thus allows current to flow directly to contact 32b, regardless of the state of the fuse 60.

It will be understood that the armatures 62a, 62b and 62c cannot operate until acted upon by the corresponding neutral, live and ground plug pins 67, 68 and 69 after they have been fully inserted into the neutral, live and ground socket outlets 22, 23 and 24, respectively. Consequently, the second neutral and the second and third live switches afford additional protection since partial insertion of substantially parallel plug pins into the socket outlets will close the first neutral and live switches, but not the second neutral and the second or third live switches. Under these circumstances the neutral and live feeders are disconnected from their respective socket outlets, which therefore remain completely safe.

The second embodiment, therefore, provides a means of protecting an electrical appliance connected via a two-pin plug to the mains supply, and interrupting that supply in the event of a faulty appliance whilst still permitting an appliance connected to the socket via a three-pin plug to operate normally.

Whilst the second embodiment has been described with particular reference to one arrangement, it will readily be understood that many modifications are possible without departing from the spirit of the invention. For example, the provision of the third live switch 61a, 61b and the fuse 60 is clearly optional. Without these components, complete insertion of a two- or three-pin plug into the socket will still effect the desired connection of the neutral and live feeders to their respective socket outlets via the first and second neutral and live switches, whilst partial insertion only of the plug prevents such connection.

Furthermore, it is also possible to exchange the positions of the second neutral and live switches so that complete insertion of the neutral pin closes the second live switch and complete insertion of the live pin closes the second neutral switch. Such an arrangement would offer additional protection in the event that the switching mechanism corresponding to the first embodiment jammed for any reason with the first live and/or neutral switches closed. Under this condition, insertion of a foreign object into one of the socket outlets would effect the feeder connection to the other outlet, thereby preventing harm from befalling the user even if the foreign object were electrically conductive.

Figure 5A:
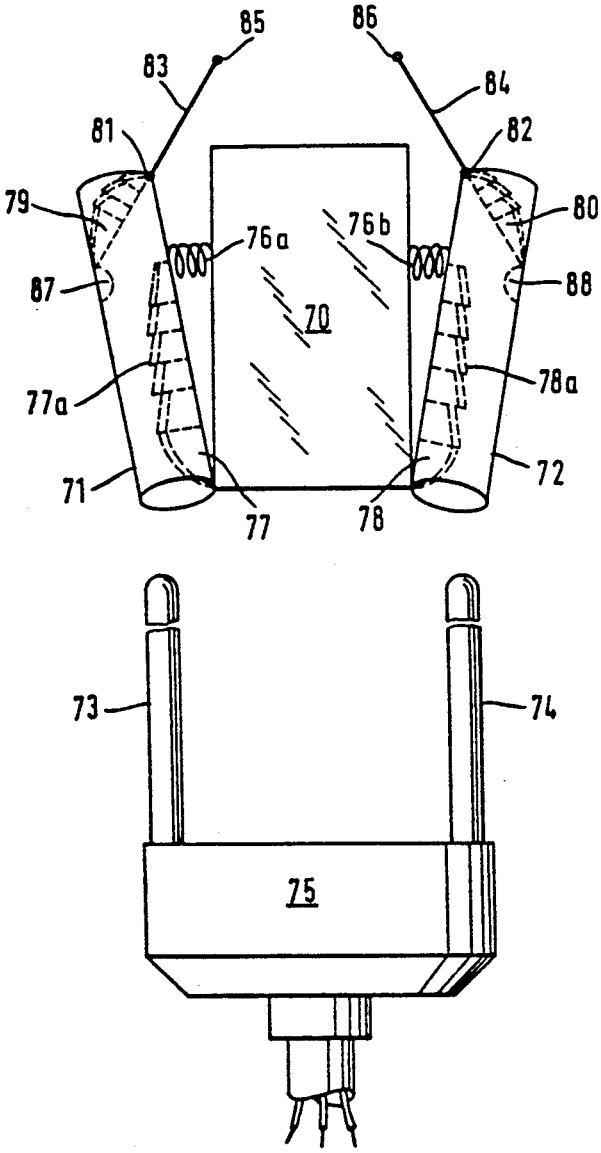
FIGS. 5*a* and 5*b* are pictorial representations of a socket according to the second embodiment of the invention illustrating an additional safety feature.
Figure 5B:
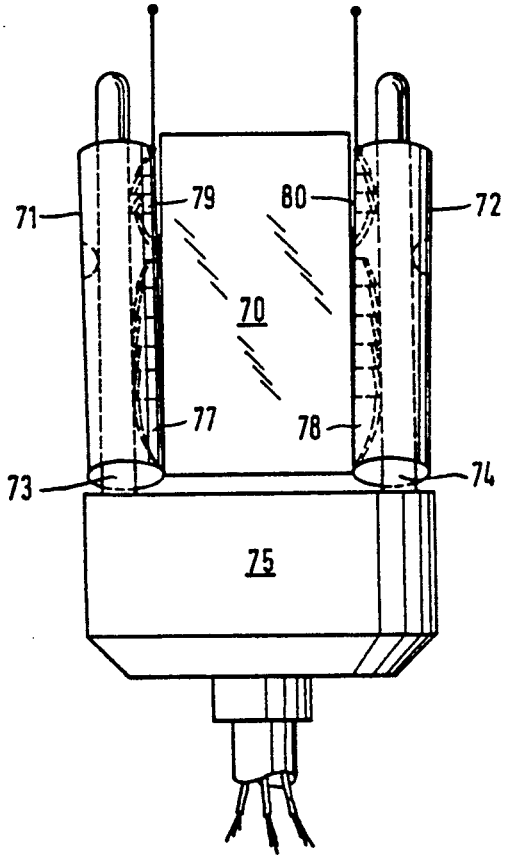

Referring to FIGS. 5a and 5b, there is shown an additional safety feature which may optionally be included in the second embodiment described above.

In FIG. 5a there is shown a switch assembly designated generally by 70 and identical to that described in detail above with reference to FIGS. 1 to 4. Neutral and live socket outlets 71 and 72, respectively, are articulated to the switch assembly 70 as described above, such that the switching mechanism 70 is adapted to operate when substantially parallel pins 73 and 74 of a plug 75 are inserted into the respective socket outlets 71 and 72. The socket outlets 71 and 72 are biased into a non-parallel dispos. 'on by means of springs 76a and 76b (constituting first ''sing means). Inside each socket outlet 71 and 72 adjacent to the switch assembly 70 are guidance means 77 and 78.

The function of the guidance means 77 and 78 is twofold. First, they prevent the pins 73 and 74 from obstructing the inside of the socket outlets adjacent to the switch assembly 70, for reasons to be described below. Furthermore, the guidance means 77 and 78 are provided with stepped protrusions 77a and 78a which serve to obstruct the complete insertion into the socket of foreign objects such as nails, etc. Such objects, if an attempt is made pivotally to rotate them, will abut one of the stepped protrusions 77a or 78a, respectively. Thus, even if the corresponding socket outlet 77 or 78 is rotated against the biasing action of the springs 76a or 76b, respectively, the foreign object will be unable to enter further and close the third or fourth switches described above the references to FIG. 4. Consequently, the neutral or live feeders will remain disconnected from the corresponding socket outlet.

The diameter of the plug pins 73, 74 is substantially smaller than the internal diameter of the corresponding socket outlets 71 and 72. The length of the plug pins 73, 74 is such that they protrude from the ends of the socket outlets 71, 72 when fully inserted therein so as to engage additional neutral and live switches (not shown) as described above with references to FIG. 4. As has also been explained above, the guidance means 77 and 78 substantially prevent the complete insertion of foreign objects into the socket outlets 71 and 72, respectively, unless such objects are inserted parallel to the axes of the socket outlets. In order to prevent a foreign object from being fully inserted into the socket outlets 71, 72 even in these circumstances, there are additionally provided therein blocking members 79 and 80 (constituting arresting means). The blocking members 79, 80 are elliptically shaped so as substantially to cover an internal conic section of the corresponding socket outlets 71, 72 when disposed in a first closed position at a non-zero angle to the axes thereof.

The blocking members 79, 80 are hingedly connected to the respective socket outlets 71, 72 about hinges 81 and 82, respectively, provided on the surface of socket outlets 71, 72 closest to the switch assembly 70. Thus, the point of connection of each hinge 81, 82 lies on the surface 9 of the corresponding socket outlet along a line parallel to the axis of the outlet and constituting an inner directrix thereof. Biasing means 83 and 84 are coupled at one end thereof to the blocking members 79 and 80, respectively, at a point on the blocking members 79, 80 adjacent to the respective hinges 81, 82 for biasing the blocking members 79 and 80 into the first position. The other ends of the biasing means 83 and 84 are hingedly coupled to the socket housing (not shown) at joints 85 and 86, respectively, such that rotation of the biasing means 83, 84 in an appropriate sense opens or closes the blocking members 79, 80 to which they are coupled. The biasing means 83, 84 are expansible and collapsible so that a rotational displacement of the socket outlets 71 and 72 into a substantially parallel position causes a suitable rotation of the blocking members 79, 80, the biasing means 83, 84 yielding so as to be accommodated within the reduced distance spanning the hinges 81, 82 to the joints 85, 86.

There are further provided protrusions 87, 88 inside the socket outlets 71 and 72, respectively, directly below the point of contact of the corresponding blocking members 79 and 80 when fully closed so as to prevent passage of the plug pins 73, 74. The protrusions 87, 88 prevent access to the free end of the blocking members 79 and 80 and thereby render it impossible to insert a thin wire or other similar object behind the free end so as to rotate the corresponding blocking member open.

The operation of the blocking members 79 and 80 is as follows. Before the plug 75 is inserted into the socket, the socket outlets 71 and 72 are mutually orientated in a non-parallel disposition. This causes the biasing means 83 and 84 to act upon the blocking members 79 and 80, respectively, so as to bias them into a position within the respective socket outlets, as shown in FIG. 5*a*, whereby the upper end of the outlet is blocked against the passage of a throughgoing object.

FIG. 5*b* shows the situation as the plug 75 is inserted within the socket. The socket outlets 71 and 72 assume a mutually parallel disposition causing the biasing means 83 and 84 to rotate about the joints 85 and 86, respectively. In so doing, they rotate the corresponding blocking members 79 and 80 about the hinges 81 and 82, respectively, into a second position which permits the plug pins 73 and 74 to pass. The guidance means 77 and 78 ensure that the plug pins 71 and 72 are not obstructed by the blocking members 79 and 80 when fully retracted into the second position.

In the feature just described with reference to FIGS. 5*a* and 5*b*, the biasing means 83 and 84 can assume a variety of forms. Thus, for example, they can be telescopic tubes which expand or contract according to whether the plug 75 is withdrawn or inserted, respectively. Alternatively, spring biasing means may be employed in order to bias the blocking members 79 and 80 into the first position. Thus, leaf or compression springs may be suitably employed to bias both the blocking members and the socket outlets as shown in FIG. 5*a*, thereby obviating the need for separate first spring biasing means 42 and 43 (referring to FIGS. 1, 2 and 4).

The stepped protrusions provided on the guidance means 77 and 78 in the above feature may also be realized in various forms, none of which is a feature of the invention. Any series of obstructions extending along substantially the whole length of the guidance means 77 and 78 may be employed, so that a foreign object inserted into the socket outlets 71 and 72, in an attempt to rotate them into a parallel disposition, will engage one of the obstructions and thereby be prevented from further entering the socket outlet. Thus, for example, a series of ridges may be provided along the length of the guidance means in order to achieve this objective.

Alternatively, a series of partial cuts may be made along an inner surface of the socket outlets normal to the axes thereof, and the material of the socket outlets between adjacent cuts may then be drawn into the socket outlets so as to create a series of disc-like protrusions extending along an inner surface of the socket outlets. The periphery of these disc-like protrusions will be equal to the length of the adjacent cuts which may be varied along the length of the socket outlet to produce a ramped series of protrusions along an inside surface thereof.

Figure 6A:
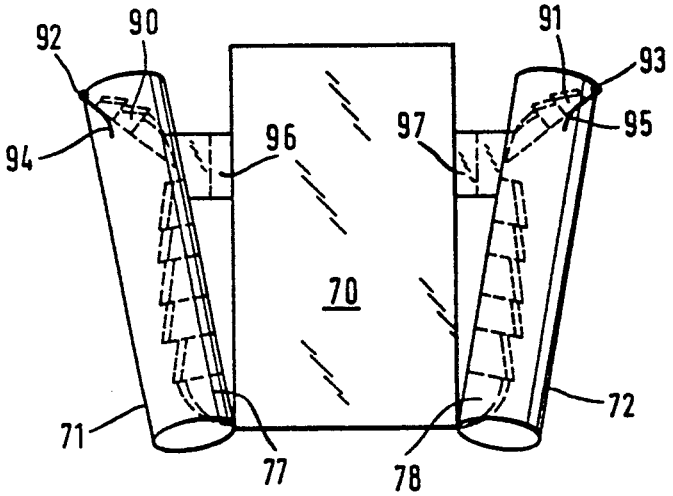
FIGS. 6*a* and 6*b* are pictorial representations of a modification to the safety feature illustrated in FIGS. 5*a* and 5*b*.
Figure 6B:
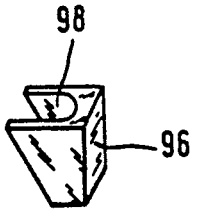

Referring now to FIGS. 6*a* and 6*b*, there is shown a modification of the safety feature described above with reference to FIGS. 5*a* and 5*b*. Similar reference numerals are used to identify those elements which are identical to those illustrated in FIGS. 5*a* and 5*b*.

In FIG. 6*a*, there are shown blocking members 90 and 91 hingedly supported to the socket outlets 71 and 72 by means of hinges 92 and 93, respectively, provided inside the corresponding socket outlets 71 and 72, at their upper ends, furthest from the switch assembly 70. Coil springs 94 and 95 are provided on the hinges 92 and 93 and constitute biasing means for biasing the blocking members 90 and 91 into a first position wherein they substantially cover an internal conic section of the corresponding socket outlets 71 and 72.

Located on each side of the switch mechanism 70 are closing means 96 and 97 which protrude through apertures (not shown) provided at the innermost sides of the socket outlets 71 and 72 and impinge on the blocking members 90 and 91 towards their lower ends. As can be seen in FIG. 6*b*, which shows a perspective view of the closing means 96, extending longitudinally through the inside of each closing means is a U-shaped recess 98 which allows a plug pin (not shown) to pass without hindrance as a plug is inserted into the socket.

The operation of the blocking members 90 and 91 is as follows. When substantially parallel plug pins are inserted into the corresponding socket outlets so as to move them into a mutually parallel disposition as described above, the closing means 96 and 97 act upon the blocking members 90 and 91, respectively, thereby rotating them about their hinges 92 and 93 against the action of the coil springs 94 and 95. Thus, as the socket outlets 71 and 72 reach a position parallel to the longitudinal axis of the switch assembly 70, the blocking members 90 and 91 are fully retracted into a second position wherein the plug pins are able to pass through the U-shaped recess (shown as 98 in FIG. 6*b*) and impinge on additional neutral and live switches (not shown) as described above with reference to FIG. 4.

It will be understood that whilst U-shaped recesses have been provided in the preferred embodiment, in general any aperture which will allow the plug pins to pass therethrough is equally suitable. Alternatively, the closing means may be provided in the form of a prong adapted to impinge on a point on the surface of the corresponding blocking means sufficiently displaced from the centre to allow unhindered passage of a plug pin.

Figure 7B:
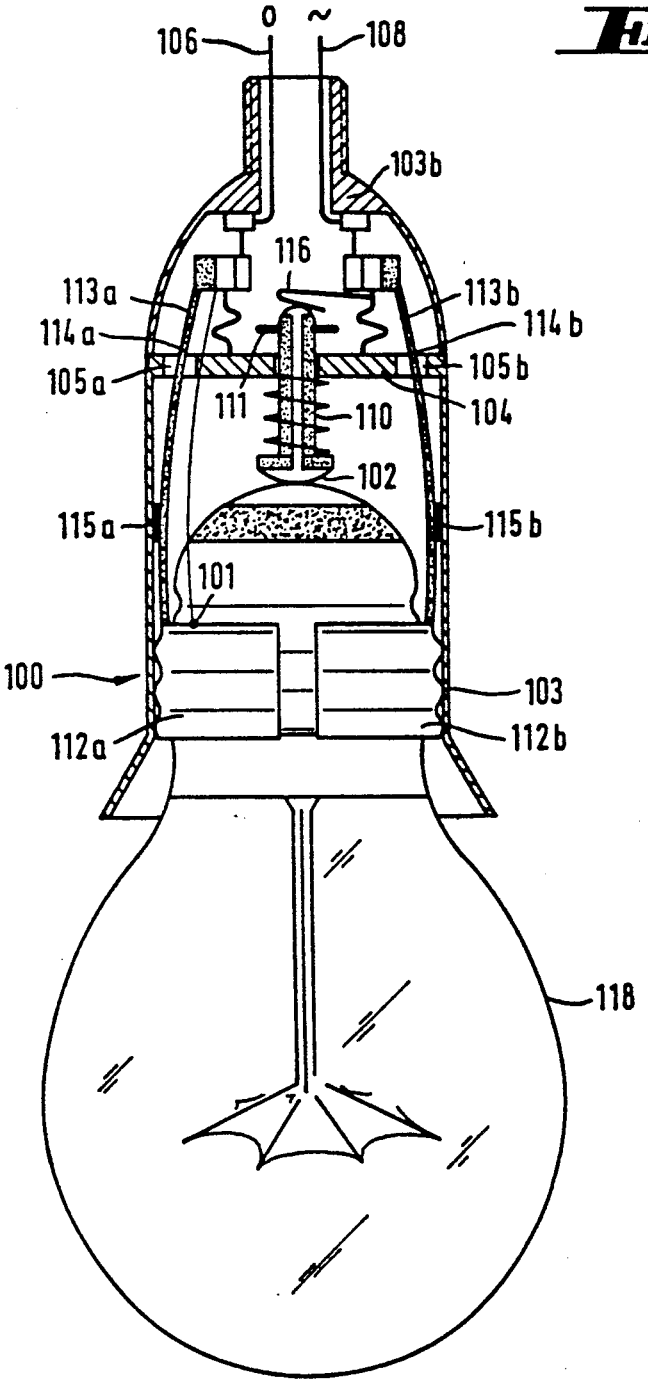

Reference is now made to FIGS. 7*a* and 7*b* which show a third embodiment according to the invention comprising a lamp safety socket 100 providing neutral and live outlets 101 and 102, respectively.

The socket 100 is provided with a housing 103 which can be dismantled into two sections by removing an end cap 103*b*, so as to facilitate connection of the socket to the mains electricity supply. At the base of the lower section of the housing 103 is a base plate 104 provided with a central aperture (not shown) and peripheral apertures 105*a* and 105*b*.

A neutral feeder 106 is connected to the neutral outlet 101 via a neutral switch comprising normally open contacts 107*a* and 107*b*. Similarly, a live feeder 108 is connected to the live outlet 102 via a live switch comprising normally open contacts 109*a* and 109*b*. The neutral outlet 101 corresponds to the screw-threaded collar in Edison-type lamp sockets but the principle of the invention is equally applicable to bayonet-type lamp sockets. The live outlet 102 corresponds to the terminal provided at the centre of an Edison-type lamp socket.

Preferably, the live outlet 102 takes the form of a spring loaded plunger 110 made from insulating material provided with a central conducting core which serves as the contact for the live outlet 102. The plunger 110 is free to move up and down through the central aperture provided in the base plate 104 and is secured therein by means of a circlip 111 engaging a groove (not shown) at the top of the plunger 110.

The screw collar 101 is made from electrically conducting material and is formed to two component portions 112*a* and 112*b* to each of which is secured insulating armatures 113*a* and 113*b*, respectively. The armatures 113*a* and 113*b* pass through the respective apertures 105*a* and 105*b* of the base plate 104 into the end cap 103*b* of the socket housing 103 and are pivotally mounted in, and with respect to, the housing 103 by means of pins 114*a* and 114*b*. Springs 115*a* and 115*b* connected between opposite sides of the housing 103 and the armatures 113*a* and 113*b*, respectively, serve to bias the two component portions 112*a* and 112*b* of the screw collar 101 towards each other.

Contact 107*a*, constituting a first contact of the neutral switch, is connected to the neutral feeder 106 and contact 109*a*, constituting a first contact of the live switch, is connected to the live feeder 108. Contact 107*b*, constituting a second contact of the neutral switch, is connected directly to the screw collar 101, and contact 109*b*, constituting a second contact of the live switch, is connected to a leaf spring contact 116 located within the end cap 103*b* directly above the central core of the plunger 110. The opposite ends of the armatures 113*a* and 113*b* remote from the screw collar 101 are adapted to engage the second contacts 107*b* and 109*b*, respectively, when a lamp 118 is screwed into the socket 100.

The operation of the lamp socket is as follows. Before the lamp 118 is screwed into the lamp socket 100, the two component portions 112*a* and 112*b* of the screw collar 101 are biased towards each other by means of the springs 115*a* and 115*b* acting on the armatures 113*a* and 113*b*, respectively. Consequently, the neutral and live switches 107*a*, 107*b* and 109*a*, 109*b* remain open and the neutral and live feeders 106 and 108 remain disconnected from their respective neutral and live socket outlets 101 and 102. Under these circumstances, the lamp socket 100 is completely safe thereby eliminating the risk of electric shock to a person making contact with the live outlet.

However, when the lamp 118 is screwed into the lamp socket 100, the two component portions 112*a* and 112*b* of the screw collar 101 are splayed apart causing the armatures 113*a* and 113*b* to pivot and push the contacts 107*b* and 109*b* towards contacts 107*a* and 109*a*, respectively, thereby closing the neutral and live switches. At the same time the lamp 118 depresses the plunger 110 against its internal spring bias towards the leaf spring contact 116, thereby completing the circuit for the live feeder 108. Under these conditions, the neutral feeder 106 is connected to the neutral outlet 101 and the live feeder 108 is connected to the live outlet 102.

Whilst in the example described, the live feeder 108 is connected to the socket outlet 102 by means of the spring-loaded plunger 110, it should be understood that there are other ways of achieving the same objective which do not require this particular mechanism.

Thus, the third embodiment provides a means of connecting neutral and live feeders to the neutral and live outlets of an electrical mains supply lamp socket such that said outlets are electrically isolated until a lamp is inserted into the socket.

What is claimed is:

1. An electrical supply safety socket, comprising:

a socket housing, first and second socket outlets articulatedly mounted with respect to the housing so as to be capable of pivotal displacement with respect to each other, a first switch having a pair of contacts connected respectively to a first feeder and the first socket outlet, a second switch having a pair of contacts connected respectively to a second feeder and the second socket outlet, first spring biasing means for biasing the outlets into a non-parallel disposition, an armature support pivotally mounted on the housing, a pair of insulating armatures articulated to the support so as to be pivotally displaceable therewith and so as to be displaceable towards and away from each other, thereby bringing respective first and second switch contacts towards and away from each other, second spring biasing means for biasing the armatures away from each other, and abutting means extending laterally from the outlets to the armatures;

whereby simultaneous displacement of the outlets into a substantially parallel disposition results in the displacement of the armatures towards one another and the contacting of the switch contacts.

2. A socket according to claim 1, wherein:

the armatures are constituted by first and second insulating bars, respective switch contacts being mounted on the bars facing each other, and the armature support is constituted by a rod pivotally mounted about its mid-point with respect to the housing and having end portions which slidingly extend through apertures formed in the bars.

3. A socket according to claim 1, wherein there are further provided third and fourth switches connected in series with the first and second switches, respectively;

the arrangement being such that partial simultaneous insertion of substantially parallel pins into the socket outlets results in the closing of the first and second switches and complete insertion of the pins results in the closing of the third and fourth switches.

4. A socket according to claim 1, wherein there are further provided arresting means associated with each of the socket outlets for arresting an object inserted into a corresponding outlet and thereby preventing pivotal displacement of the outlet.

5. A socket according to claim 3, wherein there are further provided arresting means associated with each of the socket outlets for arresting an object inserted therein and thereby preventing it from engaging the third or fourth switch, the arresting means including:

a blocking assembly juxtaposed to an upper end of the corresponding outlet and pivotally mounted with respect thereto, so as to be pivotally displaceable with said outlet from a first position in which it effectively blocks the outlet against the passage of a throughgoing object to a second position facilitating said passage.

6. A socket according to claim 5, wherein the blocking assembly comprises:

a blocking member located in said upper end of the socket outlet, and biasing means coupled to the blocking member for biasing the blocking member into said first position when the socket outlets are in said non-parallel disposition.

7. A socket according to claim 6, wherein the blocking assembly further includes a protrusion provided inside each of the socket outlets directly below its point of contact with the corresponding blocking member when in said first position, for preventing access from the front of the socket outlet to the end of the blocking member remote from the biasing means.

8. A socket according to claim 6, wherein:

the blocking member is hingedly connected to said upper end of the socket outlet by a hinge provided inside the outlet and located along a directrix of the outlet furthest from the switch assembly, and closing means are provided adjacent each side of the switch assembly for extending transversely through apertures provided in the sides of the socket outlets and rotating the respective blocking members into said second position when the socket outlets are moved into a substantially parallel disposition.

9. A socket according to claim 3, and including a third grounded outlet wherein circuit protection means is connected in series with said fourth switch, and a fifth switch is connected in series with said second switch and across the circuit protection means and fourth switch;

the arrangement being such that the simultaneous insertion of two substantially parallel pins into the first and second outlets connects the second feeder to the second outlet via the second and fourth switches and the circuit protection means, and the simultaneous insertion of three substantially parallel pins into the first, second and third outlets connects the second feeder to the second outlet via the second and fifth switches regardless of the state of the circuit protection means.

10. An electric lamp socket, comprising:

a socket housing including a collar formed of two separate collar components biased together and adapted to be splayed apart upon insertion of a lamp, first and second socket outlets, a first switch having a pair of contacts connected respectively to a first feeder and the first socket outlet, a second switch having a pair of contacts connected respectively to a second feeder and the second socket outlet, and first and second armatures respectively secured at a first end thereof to the collar components and pivotally coupled at an intermediate point thereof to the socket housing;

such that the splaying apart of the collar components displaces a second end of the armatures into closing the switches.

* * * * *